United States Patent [19]

Deutsch

[11] 4,205,577

[45] Jun. 3, 1980

[54] IMPLEMENTATION OF MULTIPLE VOICES IN AN ELECTRONIC MUSICAL INSTRUMENT

[75] Inventor: Ralph Deutsch, Sherman Oaks, Calif.

[73] Assignee: Kawai Musical Instrument Mfg. Co. Ltd., Hamamatsu, Japan

[21] Appl. No.: 898,720

[22] Filed: Apr. 24, 1978

Related U.S. Application Data

[63] Continuation-in-part of Ser. No. 803,446, Jun. 6, 1977, Pat. No. 4,178,825.

[51] Int. Cl.[2] ..... G10H 1/00; G10H 5/00

[52] U.S. Cl. ..... 84/1.21; 84/1.22; 84/1.26; 84/DIG. 9; 364/724

[58] Field of Search ..... 84/1.01, 1.03, 1.11-1.13, 84/1.19, 1.21-1.26, DIG. 9; 333/70 R, 167; 364/724; 328/167

[56] References Cited

U.S. PATENT DOCUMENTS

| | | | |
|---|---|---|---|
| 3,809,786 | 5/1974 | Deutsch | 84/1.01 |
| 3,809,788 | 5/1974 | Deutsch | 84/1.01 |
| 3,956,960 | 5/1976 | Deutsch | 84/1.19 |
| 4,108,040 | 8/1978 | Chibana et al. | 84/1.19 |
| 4,114,498 | 9/1978 | Chibana et al. | 84/1.19 |
| 4,132,140 | 1/1979 | Chibana | 84/1.11 |

*Primary Examiner*—S. J. Witkowski

*Attorney, Agent, or Firm*—Christie, Parker & Hale

[57] ABSTRACT

A polyphonic tone synthesizer in which two or more distinct voices are sounded by operation of a single key. While the voices have the same fundamental frequency, they are made audibly distinct by differing in harmonic content and differing in the shape of the envelope of the voice signal. The two or more voices are synthesized by alternately calculating master data lists of the amplitude values representative of points on the waveforms of the two voices, adding the two master data lists and converting the resulting values to an analog waveform by feeding the data to a digital-to-analog converter at a rate determined by the fundamental frequency of the note. The master data list for each voice is calculated repetitively during the time the key is operated by multiplying a set of coefficients with a set of sinusoid values and continuously scaling the resultant product by an envelope scale factor which changes with time to correspond to the desired envelope waveform. A single ADSR (attack/decay) generator may be time shared with each voice calculation to provide a differently changing envelope scale factor for each voice.

8 Claims, 4 Drawing Figures

IMPLEMENTATION OF MULTIPLE VOICES IN AN ELECTRONIC MUSICAL INSTRUMENT

RELATED CASE

This application is a continuation-in-part of application Ser. No. 803,446, filed June 6, 1977, now U.S. Pat. No. 4,178,825 entitled "A Musical Tone Synthesizer for Generating a Marimba Effect".

FIELD OF THE INVENTION

This invention relates to electronic musical instruments, and more particularly, is concerned with a polyphonic tone synthesizer for producing multiple voices for each note.

BACKGROUND OF THE INVENTION

The audible effect of multiple voices sounding the same note is well known. The multiple strings of an orchestra, the multiple voices of the chorus or choir, the multiple pipes of an organ, although they may be sounding the same note, produce a different audible effect than solo voices. This effect is the result of one or more characteristics of each voice discernible by the ear. For example, the multiple voices may not be exactly in tune, that is, they may be slightly different in pitch, resulting in an audible beat frequency. They may be frequency modulated (vibrato) differently. Even if two or more voices are identical in pitch they may sound as multiple voices because the harmonic content of the respective voices may be changing differently while the voices are being sounded. Also, the amplitude envelope of the several voices may be changing differently, that is, the attack/decay characteristic of the individual voices may be different.

While multiple voices can now be created independently in known electronic musical instruments, this has been accomplished by providing a multiplicity of tone generating channels for each note. A separate channel must be employed if any of the above characteristics are to be controlled independently.

SUMMARY OF THE INVENTION

The present invention is directed to a polyphonic tone synthesizer which provides means for simultaneously generating several voices for each note. These voices can be generated in a common tone generating channel. The present invention permits independent ADSR envelope and sliding format filtering for each individual voice through the common tone generating channel. This is accomplished, in brief, by calculating a single master data list for one tone generating channel in a series of subcomputation cycles, each subcomputation cycle producing a set of values corresponding to the amplitudes of points defining one harmonic of the desired waveform of one of the voices. The values of each set are added to the accumulated sum of the sets of values from previous subcomputation cycles. After the subcomputation cycles are completed, the resulting master data list is transferred to the tone generator and the computation process is repeated. The present invention permits the value of the points of each set relating to one of the multivoices to be scaled by a scale factor which may vary as a function of time independently of the scale factor associated with any of the other voices. Thus the relative magnitude of the sets of computed values may be varied with time to produce a changing waveform comprising multiple voices, each voice changing in harmonic content in a predetermined manner.

DESCRIPTION OF THE DRAWINGS

For a more complete understanding of the invention, reference should be made to the accompanying drawings, wherein.

DETAILED DESCRIPTION

Figure 1:
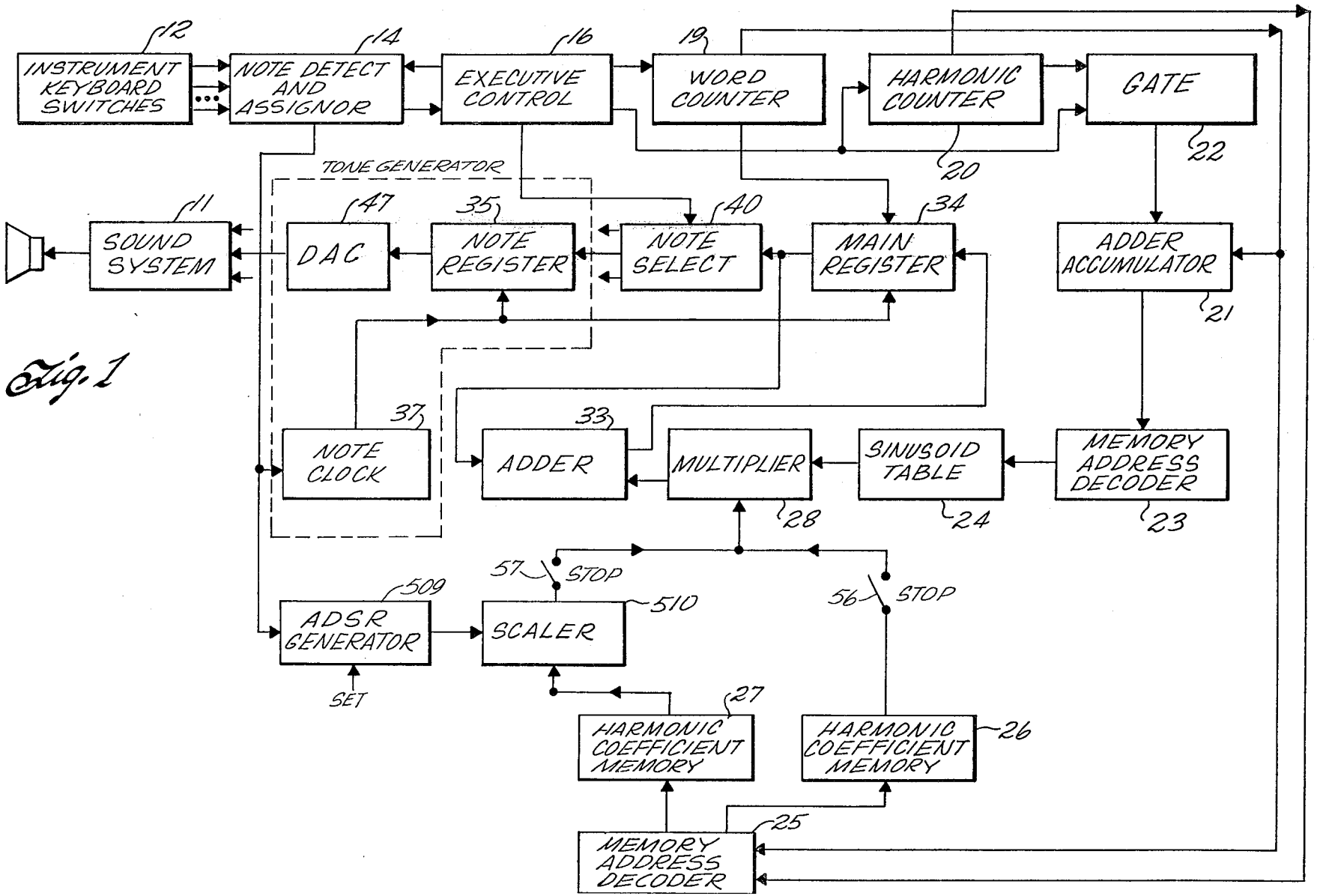
FIG. 1 is a schematic block diagram of one embodiment of the invention.

The preferred embodiment of the present invention is implemented as a modification to the polyphonic tone synthesizer described in copending application Ser. No. 603,776, filed Aug. 11, 1975, entitled "Polyphonic Tone Synthesizer" and issued as U.S. Pat. No. 4,085,644, hereby incorporated by reference. The polyphonic tone synthesizer described in the above-identified application has a plurality of tone generators. Each tone generator, when assigned to a key depressed on the keyboard, produces a musical tone from a digitally computed master data set. The master data set, computed during a computation mode, is stored in a buffer memory or shift register from which the data is repetitively read out serially in real time at a rate determined by the pitch or fundamental frequency of the tone being generated, the data being applied to a digital-to-analog converter which transforms the data to a corresponding analog voltage waveform for driving an audio sound system. The master data sets for the respective assigned tone generators are calculated repetitively on a time-shared basis independently of tone generation by computing a Fourier sine equation using stored sets of generalized Fourier coefficients and a table of sinusoid data. The above elements in the present disclosure which are common to the disclosure in the above-identified patent are identified by the same two-digit reference characters.

Referring in detail to FIG. 1, the tone synthesizer comprises a keyboard 12, the keyboard having a plurality of switches operated by the individual keys. When any key is depressed, a note detect and assignor circuit 14, described in detail in U.S. Pat. No. 4,022,098, stores information, during the time the associated switch is closed, identifying the particular note, the octave and division of the note being played. An executive control circuit 16 receives a signal from the note detect and assignor circuit 14 indicating that one or more keys are depressed. As long as any key is depressed, the executive control 16 initiates a series of computation cycles. During each computation cycle, a master data set is calculated and loaded into a main shift register 34. The manner in which the master data set is calculated is described in detail in the above-identified U.S. Pat. No. 4,085,644.

After a master data set is loaded in the main register 34, the data set is transferred by a note select circuit 40, in response to the executive control 16, into a note shift register 35. The shift rate of the register 35 is controlled by a note clock 37, the clock frequency of the note clock 37 being set by the note and octave information derived from the note detect and assignor circuit 14. The note clock frequency is controlled so as to be proportional to the pitch of the note selected by the associated key on the instrument keyboard. Once the master data set is transferred from the main register 34 to a note shift register 35, the executive control 16 initiates a new computation cycle to load the main register 34 with the same or a new master data set. If only one key is depressed, the computation cycle is repeated for the same key; if more than one key is depressed, the computation cycle is repeated for each key after the computation cycles for all the other depressed keys have been executed.

The master data set in the note register 35 is shifted to a digital-to-analog converter (DAC) 47 by the note clock 37, the converter generating an audio frequency output voltage having a fundamental frequency determined by the note clock 37. The amplitude of the audio output voltage changes in incremental steps proportional to the numbers successively shifted out of the note register 35. The analog voltage from the DAC for each tone generator is applied to a sound system 11 for driving a loudspeaker which reproduces the synthesized tones.

As described in detail in the above-identified U.S. Pat. No. 4,085,644, during the computation cycle the master data set is calculated from one or more sets of harmonic coefficients stored in coefficient memories, two of which are indicated at 26 and 27, and from a set of sinusoid or other orthogonal function values stored in the sinusoid table 24. Each coefficient memory has an associated Stop switch, such as indicated at 56 and 57, which is set by the musician to control the number of voices to be generated. While only two coefficient memories 26 and 27 are shown for storing two sets of harmonic coefficients, it will be understood that any number of stops and associated sets of harmonic coefficients may be provided. Typically the upper division, for example, may have ten different stops. The calculation of the master data set is under the control of a word counter 19 and harmonic counter 20. After a computation cycle is initiated by a signal from the executive control 16, the word counter 19 is counted up in synchronism with the shifting of the main register 34. The word counter 19 has a modulo corresponding to the number of words stored in the main register 34, e.g., thirty-two. Counting of the word counter 19 causes a set of values in the sinusoid table to be addressed in sequence, the address of the set being different for each harmonic.

The harmonic coefficients in memories 26 or 27 are addressed sequentially in response to a harmonic counter 20 through a memory address decoder 25. Each coefficient from the memories 26 or 27 is applied as one input to the multiplier 28. The sinusoid values in the tables 24 are addressed by an adder-accumulator 21 through an address decoder 23. The contents of the harmonic counter 20 are added to the accumulator 21 with each count of the word counter 19.

The content of the harmonic counter 20 is gated to the adder-accumulator through a gate 22 each time the harmonic counter 20 is advanced by the executive control 16. The adder-accumulator 21 adds the number derived from the harmonic counter 20 to itself with each advance of the word counter 19. Thus when the harmonic counter corresponds to the first harmonic calculation, the output of the adder-accumulator will advance from one to thirty-two so as to successively address the first thirty-two words in the sinusoid table 24. This iterative process completes the first subroutine. At the end of the first subroutine, the contents of the main register 34 is thirty-two words, each word being the product of the harmonic coefficient for the first harmonic and the series of sine values. The values of these words correspond to the amplitudes of thirty-two points along one-half cycle of a sinewave, representative of the fundamental or first harmonic of the waveform being generated in response to the setting of the first stop switch 56.

The memory address decoder then causes the word counter 19 to address the second harmonic coefficient memory 27, the harmonic counter 20 remaining unchanged. Thus a second set of thirty-two values are generated in sequence at the output of the multiplier 28 during the second counting cycle of the word counter 19. These values are added to the existing set of values in the main register 34 by the adder 33. Additional subroutines, if required, cause the harmonic coefficients of additional stops to be multiplied with the output of the sine table and added to the words in the main register 34. At the completion of these subroutines, the harmonic counter 20 is advanced one and the above subroutines are repeated on the next coefficient value in each of the harmonic coefficient memories using a new set of values from the sinusoid table 24. With each advance of the harmonic counter 20, the next higher harmonic is calculated and added to the contents of the main register 34. When the harmonic counter 20 is advanced to its maximum count, corresponding to the highest harmonic in the calculated waveshape, calculation of the master data set in the main register 34 is complete.

At the completion of the computation cycle, the master data set is transferred from the main register 34 to the note register 35 in synchronism with the note clock. The manner in which the two shift registers are synchronized during the transfer so as not to interrupt the flow of data from the note register to the digital-to-analog converter is described in detail in the above-identified U.S. Pat. No. 4,085,644. Once the transfer from the main register 34 is completed, the executive control 16 initiates a new computation cycle. The repetitive computation cycle allows the master data set to be modified as a function of time, permitting the envelope and harmonic contents of the audio tone to be modulated in a manner hereinafter described in detail.

As thus far described, the polyphonic tone synthesizer corresponds to the arrangement described in the above-identified U.S. Pat. No. 4,085,644. The calculation cycle is repeated for the calculation of the master data set for additional tone generators where more than one key is operated on the keyboard of the polyphonic tone systhesizer. While more than one stop switch may be set in the arrangement as thus far described, the resulting tone does not produce the audio effect of multiple voices. Rather the resulting tone sounds like a single voice having the complex waveform produced by the combined tone characteristics of the several stops which have been set. To create the audio effect of multiple voices from a single tone generator, according to one embodiment of the invention as shown in FIG. 1, the attack/decay characteristic of each voice (one stop corresponding to one voice) is controlled separately. Normally the attack/decay of a tone is controlled at the output of the tone generator by varying the amplitude envelope of the resulting audio signal in the desired manner as a function of time. However, by controlling the amplitude of the individual voices, the output of the single tone generator can be made to sound like multiple voices rather than a single voice. To this end, scaler circuits, one of which is indicated at 510, are connected between any or all of the harmonic coefficient memories and the multiplier 28 for multiplying each of the harmonic coefficient values read out of the associated memory by a scale factor which changes as a function of time in a manner controlled by an ADSR generator 509. The ADSR generator may take a variety of forms, such as the ADSR generators described in U.S. Pat. No. 3,610,805 or U.S. Pat. No. 4,079,650. Where the invention is applied to a single tone generator at a time, a simpler method for controlling the scale factor in the arrangement of FIG. 1 is described in copending application Ser. No. 803,447, filed June 6, 1977, entitled "Amplitude Generator for an Electronic Organ" and now U.S. Pat. No. 4,144,789. Operation of the ADSR generator is triggered by the executive control 16 when a key is operated and assigned to the tone generator. The ADSR generator produces a digital output which changes in value with time according to the desired changes in the amplitude of the envelope of the voice being controlled. The characteristic of the ADSR generator may be set by the musician to produce the desired characteristic, such as a fast attack with slow release to produce a percussive type sound.

While FIG. 1 shows scaling of only one set of harmonic coefficients, the output of each of the harmonic coefficient memories may be separately amplitude modulated by a scaler controlled by an ADSR generator. Alternatively a single scaler may be provided either at the output of the sinusoid table 24 or the output of the multiplier 28, as shown for example in FIG. 2. In the arrangement shown in FIG. 2 the ADSR generator 509' is preferably a time-shared generator of the type described in U.S. Pat. No. 4,079,650 modified in the manner described below in connection with FIG. 3. The ADSR generator 509' is controlled by the memory address decoder 25 so that a different value is produced on the output of the ADSR generator for each of the respective coefficient memories. Thus the ADSR generator 509' provides a separate control on a time-shared basis for each of the voices or stops for each tone generator. A note select 40 permits several tone generators to be used, one additional tone generator being shown with note clock 38, note shift register 35', and DAC 48.

Figure 3:
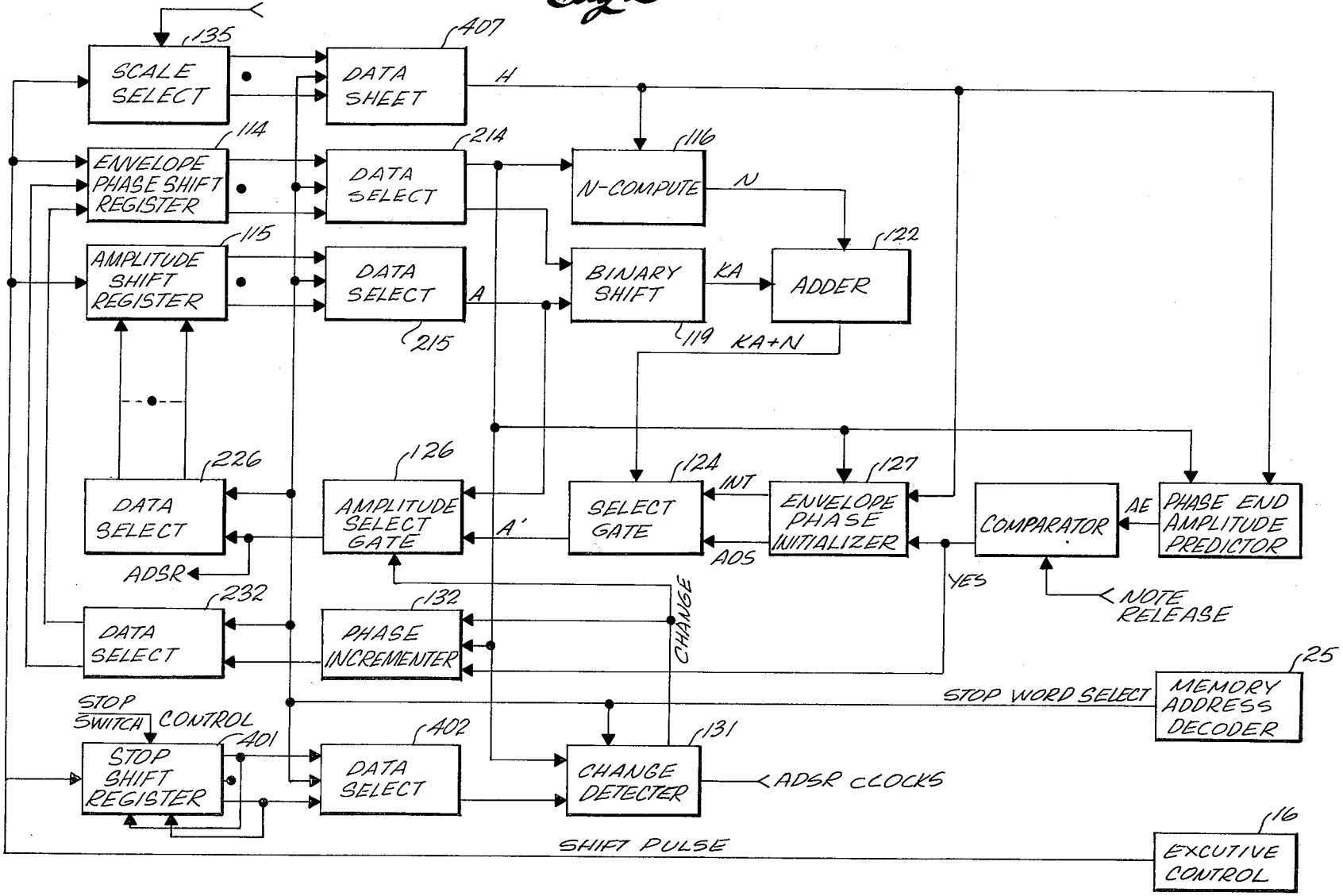
FIG. 3 is a schematic block diagram of an ADSR generator for providing multiple voices in a single tone generating channel.

Referring to FIG. 3, there is shown a block diagram of a modified ADSR generator of the type described in detail in U.S. Pat. No. 4,079,650, which is hereby incorporated by reference. As described in the patent, the ADSR generator includes an amplitude shift register 115 which stores the current envelope amplitude value for each of the tone generators in the polyphonic tone synthesizer. To provide multiple voices for each of these tone generators in accordance with the present invention, each word in the amplitude shift register includes a plurality of groups of bits, the number of groups corresponding to the number of stops, e.g., ten. Each group of bits corresponds to the current amplitude value of the envelope for the corresponding voice of the multi-voice channel.

Similarly an envelope phase shift register 114 stores a group of words, one for each tone generator. The envelope phase shift register is modified so that each word has ten groups of bits, each group of bits being associated with one of the voices of the multi-voice channel. Each group of bits in each word in the envelope phase shift register 114 identifies the current phase of the envelope. As described in the above-identified patent on the ADSR generator, the envelope curve is divided into two attack phases, two decay phases, and two release phases. Which phase of the envelope a particular voice of a particular tone generator is in determines the manner in which the amplitude value is modified by the ADSR generator to conform to the next point on the desired amplitude envelope curve. By knowing a constant value H as derived from a scale select register 135, and the current phase as derived from the envelope phase shift register 114, the current amplitude A as derived from the amplitude shift register 115 is used to calculate a new value A' of amplitude at the output of a select gate 124, using the N-compute circuit 116, binary shift circuit 119, and adder 122, all in the manner described in detail in the above-identified U.S. Pat. No.4,079,650. A select gate 124 selects the calculated value or an initial value of A' from envelope phase initializer 127. An amplitude select gate 126 controlled by a change detector 131 either changes the associated amplitude value in the amplitude shift register 115 to the new value A', or leaves the current amplitude value A unchanged.

Figure 2:
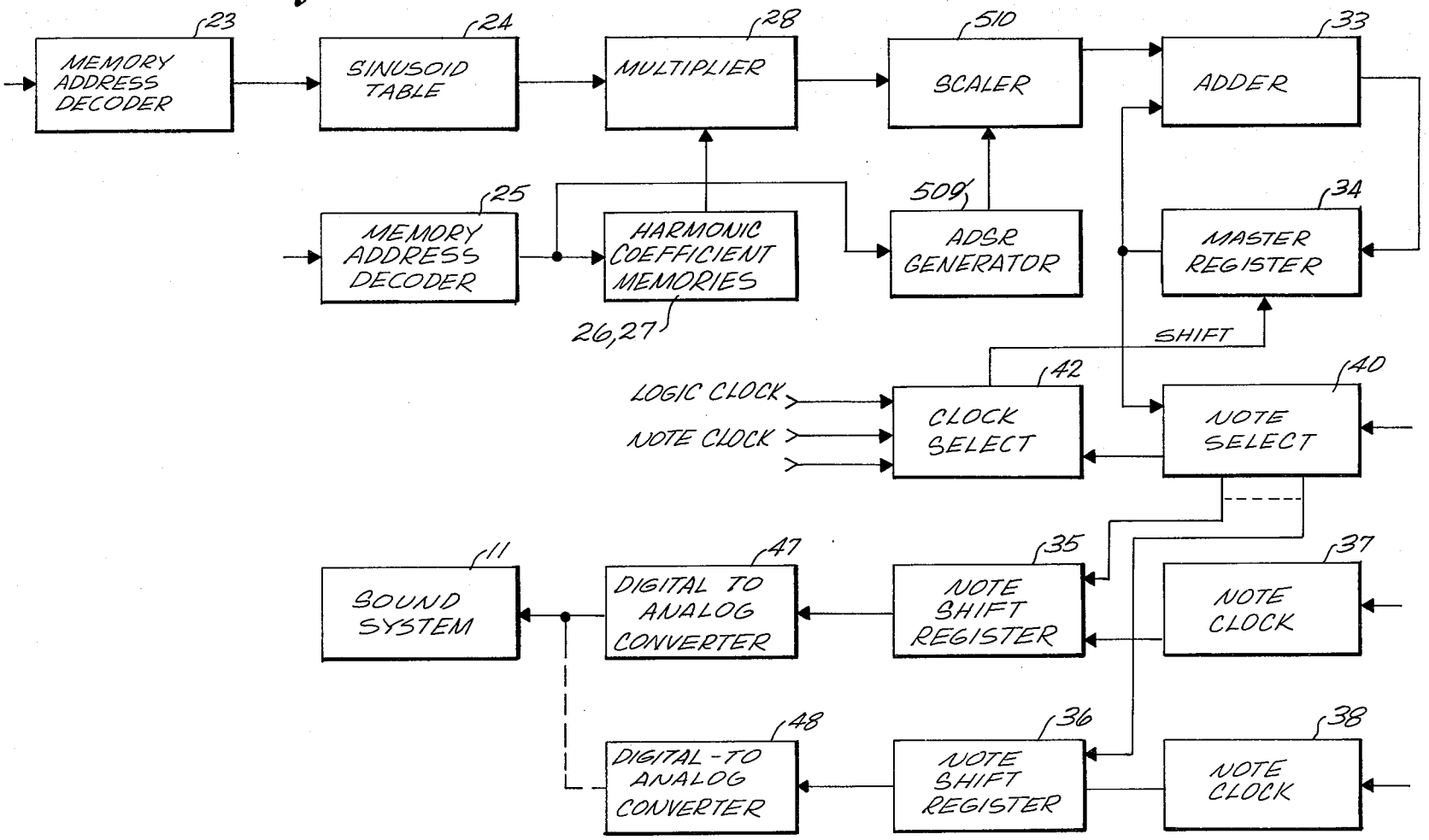
FIG. 2 is a schematic block diagram of an alternative embodiment of the invention.

The ADSR generator operates on a time-shared basis, making the above-described computation on each of the ten voices in sequence by scanning the ten groups of bits in each word as they are shifted out of the amplitude shift registers 114 and 115. The shifting of these registers is controlled by the Executive Control 16 so as to be in synchronism with the scanning of the tone generators by the note detect and assignor circuit 14. The scanning of the ten groups of bits of each word at the output of the shift registers 114 and 115 is controlled by the output of the memory address decoder 25, as described in connection with FIG. 1. As noted above, the memory address decoder 25 selects in sequence the harmonic coefficient memories associated with each of the stops. The memory address decoder 25, in addition to selecting one of the harmonic coefficient memories, is used to select the groups of bits from the words being read out of the shift registers 114 and 115 associated with the same stop as the coefficient memory. To this end, the output of the memory address decoder 25 is applied to data select circuits 214 and 215 to select the appropriate one of the groups of bits of the words as they are shifted out of the registers 114 and 115. Either the current amplitude value A or the calculated new amplitude value A', as selected by the amplitude select gate 126, is applied to the output from the ADSR generator 509' to the scaler 510, as shown in FIG. 2. Thus as the memory address decoder 25 shifts the calculation from voice to voice, the ADSR generator 509' applies the corresponding current amplitude value to the scaler 510 corresponding to the voice (stop) being calculated. A data select circuit 226, in response to the output of the decoder, applies the output of the ADSR to the appropriate group of bits in the word at the output of the amplitude shift register 115 to update the amplitude value.

The change detector 131 of the ADSR generator is also modified slightly from that described in the change detector of U.S. Pat. No. 4,079,650 in that separate groups of ADSR clocks are provided for each voice. An ADSR clock is selected by the change detector 131 depending upon the current phase, the current voice (stop) and the current tone generator for which the amplitude value is being calculated by the ADSR generator. The status of the stop switches for each tone generator is stored as bits in a word in a stop register 401 which is shifted in synchronism with the register 114 and 115. The bits of the word shifted out of the register 401 are applied to the input of a data select circuit 402 which selects one of the stop switch status bits based on the output of the memory address decoder 25. The logic of the change detector 131 determines whether the corresponding stop switch has been set or not and if the appropriate ADSR clock is currently generating an output pulse, and if both conditions are true, it causes the amplitude select gate 126 to change the current amplitude value A to the newly calculated value A'. The output of the change detector 131 signals a phase increment 132 to increment the phase value of the word portion in the envelope phase shift register 114. The word portion is selected by a data select circuit 232 in response to the Stop Word Select signal from the decoder 25.

Thus it will be apparent that the ADSR generator 509', as shown and described in connection with FIG. 3, provides the current amplitude factor for each of the voices in sequence on a time-shared basis to the scaler 510. The amplitude factor for each of the voices is modified as a function of time by the ADSR generator in a manner which is individually controlled for each voice and for each tone generator. The envelope waveform is determined by the value of the constant H for the particular stop as selected by the data select circuit 407 and the scale select register 135. The rate of change of the amplitude as a function of time is determined by the clock rate of the individual ADSR clocks associated with each voice as selected by the change detector 131. Both the value of H and the clock rates may be set by the musician to produce the desired envelope waveshape for each voice selected in turn by the setting of the stop switches.

Figure 4:
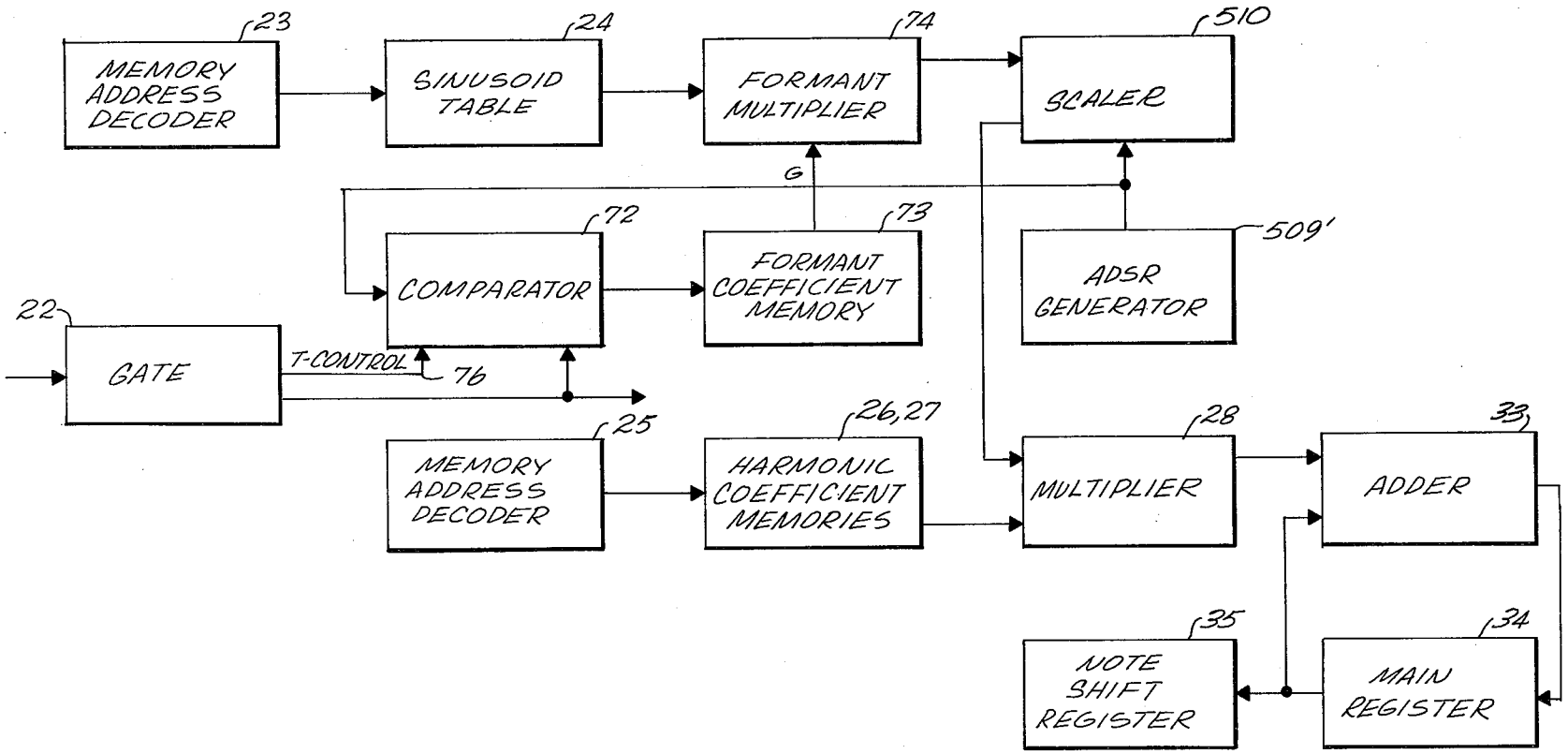
FIG. 4 is a schematic block diagram of another embodiment of the invention in which independent control of the sliding formants is provided.

Individual formant control for each voice of the multi-voice tone generator can be implemented in the manner shown in FIG. 4. The effective sliding formant filter is implemented substantially in the manner described in the above-identified U.S. Pat. No. 4,085,644, as described in connection with FIG. 5 of that patent. More specifically, a gain factor is applied to the output of the sinusoid table 24 by a format multiplier 74, the gain factor being derived from a formant coefficient memory 73. The formant coefficient memory is addressed by the output of the comparator 72 which compares the output of the ADSR generator 509' with the harmonic number derived from the harmonic counter 20 through the gate 22. A T-control 76 to the comparator 72 may be used to cause the format filter to act as a low pass or a high pass filter, all as described in U.S. Pat. No. 4,085,644.

Assuming a low pass filter operation is set by the T-control 76, as long as the ADSR value for the particular voice being computed is greater than the harmonic number, the gain factor applied to the multiplier 74 is set at one. Whenever the harmonic number is greater than the ADSR value, the difference value is applied by the comparator 72 to the formant coefficient memory 73 as an address for reading out a selected gain factor from the memory 73. Thus for all harmonics above a predetermined harmonic value determined by the ADSR generator, the amplitude is attenuated by the multiplier 74 according to the value of the gain factor read out of the memory 73. The output value of the ADSR generator 509', which changes as a function of time in the manner described above, therefore causes the cutoff harmonic of the formant filter also to shift or slide as a function of time. While the formant filter is shown as controlled by the ADSR generator, the sliding formant filter can be controlled by other well known means, such as by separate manual controls for each voice. Any control providing an input to the comparator 72 must be time-shared by the different voices, as is the ADSR generator 509'.

From the above description it will be seen that an arrangement is provided for producing the effect of multiple voices through a single tone generator. This is accomplished by computing a single master data list using a plurality of separate sets of harmonic coefficients, each one associated with a different voice or stop. By scaling each set of harmonic coefficients differently as a function of time, the tone generated in response to the resulting mastter data list produces the effect of multiple voices.

What is claimed is:

1. A keyboard-operated digital tone generator producing the effect of multiple voices when a single key is depressed, comprising: means storing a table of orthogonal function values, a multiplier, means reading out a set of orthogonal function values sequentially from said means storing a table of orthogonal function values and applying each function value to the multiplier, means storing a separate set of harmonic coefficient values for each voice, means reading out the coefficient values in sequence from each set of harmonic coefficients and applying each of said coefficient values in sequence to the multiplier for multiplication with each of said orthogonal function values, each set of coefficients when multiplied with each of said orthogonal values generating a corresponding number of intermediate values, adder/accumulator means for accumulating the sums of the intermediate values resulting from each set of coefficients, variable scaler means for scaling the output of the multiplier by a scale factor determined by a control input to the scaler means, means connected to the control input of the scaler means for generating a separate scale factor for each set of harmonic coefficients, means selectively applying the scale factor associated with a particular set of coefficients to the control input of the scaler means at the same time the coefficient value from the same set of coefficients is being read out, whereby the scaler means provides a different scale factor for each set of harmonic coefficient values.

2. Apparatus of claim 1 wherein said means generating a separate scale factor for each set of coefficient values further includes means for individually varying the scale factor associated with at least one of said sets of harmonic coefficient values with time in a predetermined manner.

3. Apparatus of claim 2 wherein said scaler means is connected between the source of stored harmonic coefficient sets and the multiplier.

4. Apparatus of claim 2 wherein said scaler means is connected to the output of the multiplier.

5. Apparatus of claim 2 further including sliding formant filter means for scaling the output of the multiplier by a predetermined scale factor that varies in a predetermined manner with each harmonic value read out of said means for storing the sets of coefficient values.

6. In a keyboard operated tone synthesizer in which a master data list of amplitude values is converted to an audio tone, apparatus for producing the audio effect of multiple voices comprising: computing means including means storing a set of orthogonal function values, means storing a plurality of sets of harmonic coefficient values, means including a multiplier for multiplying each of the harmonic coefficient values from one set of harmonic coefficient values with a set of orthogonal function values, means adding and accumulating the sets of products from the multiplier resulting from the multiplication of one set of orthogonal function values with one harmonic coefficient value with the sets of product values resulting from each of the other harmonic coefficient values to form the master data list; control means repetitively activating said computing means for periodically recomputing the master data list; scaling means for scaling by a variable scale factor the magnitude of each set of coefficients, means changing the scale factor of the scaling means with each set of coefficients applied to the multiplier, and means changing the scale factor of the scaling means as a function of time in a predetermined manner at a change rate that is slow compared to the computation rate of the master data list.

7. Apparatus of claim 6 wherein the scaling means is connected between the source of stored harmonic coefficient sets and the multiplier.

8. Apparatus of claim 6 further including sliding formant filter means for scaling the output of the multiplier by a predetermined scale factor that varies in a predetermined manner with each harmonic value read out of said means for storing the sets of coefficient values.

* * * * *